US009193187B2

(12) United States Patent
Yamagata

(10) Patent No.: US 9,193,187 B2
(45) Date of Patent: Nov. 24, 2015

(54) GAP CONTROL METHOD FOR A MEDIA PROCESSING DEVICE, AND A MEDIA PROCESSING DEVICE

(75) Inventor: Yasuhiro Yamagata, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 181 days.

(21) Appl. No.: 13/040,471

(22) Filed: Mar. 4, 2011

(65) Prior Publication Data

US 2011/0217105 A1 Sep. 8, 2011

(30) Foreign Application Priority Data

Mar. 4, 2010 (JP) ..... 2010-047505

(51) Int. Cl.

| | |
|---|---|
| ***B41J 11/20*** | (2006.01) |
| ***B41J 25/308*** | (2006.01) |
| *B41J 3/60* | (2006.01) |
| *B41J 11/00* | (2006.01) |

(52) U.S. Cl.

CPC ..... *B41J 11/20* (2013.01); *B41J 25/308* (2013.01); *B41J 3/60* (2013.01); *B41J 11/0045* (2013.01)

(58) Field of Classification Search

USPC ..... 400/55, 59, 605, 607, 691, 692, 693.1, 400/456, 268, 355, 366, 425; 347/8, 19, 20; 399/18, 21, 22

See application file for complete search history.

(56) References Cited

U.S. PATENT DOCUMENTS

| | | | | | |
|---|---|---|---|---|---|
| 4,178,106 | A | * | 12/1979 | Mailer et al. | 400/57 |
| 5,000,590 | A | * | 3/1991 | Einem | 400/55 |
| 5,570,959 | A | * | 11/1996 | Moriwaki et al. | 400/56 |
| 5,588,755 | A | * | 12/1996 | Nimura | 400/234 |
| 5,594,487 | A | * | 1/1997 | Nuita et al. | 347/197 |
| 5,609,426 | A | * | 3/1997 | Ito et al. | 400/279 |
| 5,613,783 | A | * | 3/1997 | Kinney et al. | 400/73 |
| 5,634,729 | A | * | 6/1997 | Kinney et al. | 400/73 |
| 5,664,895 | A | * | 9/1997 | Asai et al. | 400/248.1 |
| 5,772,339 | A | * | 6/1998 | Yamaguchi | 400/55 |
| 5,863,139 | A | * | 1/1999 | Asai et al. | 400/248.1 |
| 5,868,508 | A | * | 2/1999 | Suzuki | 400/692 |
| 5,893,667 | A | * | 4/1999 | Kinney et al. | 400/73 |

(Continued)

FOREIGN PATENT DOCUMENTS

| | | | |
|---|---|---|---|
| JP | 60027587 | A * | 2/1985 |
| JP | 11020261 | A * | 1/1999 |

(Continued)

*Primary Examiner* — Daniel J Colilla
*Assistant Examiner* — Quang X Nguyen
(74) *Attorney, Agent, or Firm* — Nutter McClennen & Fish LLP; John J. Penny, Jr.

(57) ABSTRACT

A media processing device moves a first printhead in a direction away from a first platen and sets the gap therebetween to a wide second gap until the magnetic ink character printing area of the recording medium passes the reading position. When this printing area on the recording medium passes the reading position A, the first printhead moves in the direction approaching the first platen, and the gap therebetween is reset to a first gap that is narrower than the second gap. Because the gap is wide during the magnetic ink character reading operation, the leading end of the recording medium when conveyed to a position passed the first printhead will not catch on the second printhead, and conveying the recording medium at a constant speed will not be impeded. The magnetic ink characters can therefore be accurately read.

12 Claims, 6 Drawing Sheets

(56) References Cited

U.S. PATENT DOCUMENTS

| | | | | | |
|---|---|---|---|---|---|
| 5,997,192 | A | * | 12/1999 | Martinez et al. | 400/58 |
| 6,007,263 | A | * | 12/1999 | Imai et al. | 400/693 |
| 6,097,414 | A | * | 8/2000 | Menzenski | 347/188 |
| 6,123,260 | A | * | 9/2000 | Menzenski | 235/449 |
| 6,183,148 | B1 | * | 2/2001 | Martinez et al. | 400/120.17 |
| 6,231,249 | B1 | * | 5/2001 | Harris | 400/188 |
| 6,261,008 | B1 | * | 7/2001 | Omura | 400/58 |
| 6,350,005 | B1 | * | 2/2002 | Asai et al. | 347/19 |
| 6,394,568 | B1 | * | 5/2002 | Menendez | 347/8 |
| 6,504,623 | B1 | * | 1/2003 | Ito | 358/1.18 |
| 6,517,268 | B1 | * | 2/2003 | Omura et al. | 400/223 |
| 6,523,927 | B2 | * | 2/2003 | Asai et al. | 347/19 |
| 6,530,704 | B2 | * | 3/2003 | Omura | 400/58 |
| 6,695,427 | B2 | * | 2/2004 | Murata et al. | 347/19 |
| 6,832,723 | B2 | * | 12/2004 | Murata et al. | 235/439 |
| 6,883,987 | B2 | * | 4/2005 | Kamin et al. | 400/605 |
| 6,955,488 | B2 | * | 10/2005 | Uehara | 400/692 |
| 6,983,885 | B2 | * | 1/2006 | Endo et al. | 235/449 |
| 7,044,570 | B2 | * | 5/2006 | Takahashi et al. | 347/8 |
| 7,434,902 | B2 | * | 10/2008 | Baker et al. | 347/8 |
| 7,470,072 | B2 | * | 12/2008 | Furihata | 400/59 |
| 7,770,793 | B2 | * | 8/2010 | Sasaki et al. | 235/449 |
| 7,883,173 | B1 | * | 2/2011 | Tratar et al. | 347/22 |
| 7,976,231 | B2 | * | 7/2011 | Addison et al. | 400/59 |
| 2001/0016137 | A1 | * | 8/2001 | Omura | 400/649 |
| 2001/0021331 | A1 | * | 9/2001 | Brewington et al. | 400/188 |
| 2002/0067386 | A1 | * | 6/2002 | Asai et al. | 347/19 |
| 2002/0098025 | A1 | * | 7/2002 | Lee et al. | 400/55 |
| 2002/0195492 | A1 | * | 12/2002 | Murata et al. | 235/440 |
| 2003/0002908 | A1 | * | 1/2003 | Hirabayashi et al. | 400/649 |
| 2003/0039499 | A1 | * | 2/2003 | Kelley et al. | 400/56 |
| 2003/0047609 | A1 | * | 3/2003 | Endo et al. | 235/454 |
| 2003/0156880 | A1 | * | 8/2003 | Kamin et al. | 400/582 |
| 2005/0100377 | A1 | * | 5/2005 | Honda et al. | 400/55 |
| 2005/0105104 | A1 | * | 5/2005 | Sakai et al. | 358/1.1 |
| 2005/0226664 | A1 | * | 10/2005 | Redman et al. | 400/55 |
| 2006/0039732 | A1 | * | 2/2006 | Huggins et al. | 400/55 |
| 2006/0115312 | A1 | * | 6/2006 | Furihata et al. | 400/149 |
| 2006/0181556 | A1 | * | 8/2006 | Wanibuchi et al. | 347/8 |
| 2006/0198683 | A1 | * | 9/2006 | Sasaki et al. | 400/607.2 |
| 2006/0216092 | A1 | * | 9/2006 | Ueda et al. | 400/55 |
| 2006/0233579 | A1 | * | 10/2006 | Ono | 400/55 |
| 2006/0257185 | A1 | * | 11/2006 | Furihata | 400/55 |
| 2007/0110491 | A1 | * | 5/2007 | Vandermeulen | 400/55 |
| 2007/0147926 | A1 | * | 6/2007 | Rathbun et al. | 400/55 |
| 2007/0211094 | A1 | * | 9/2007 | Roth et al. | 347/14 |
| 2009/0154977 | A1 | * | 6/2009 | Addison et al. | 400/59 |
| 2009/0219551 | A1 | * | 9/2009 | Sakai et al. | 358/1.1 |
| 2010/0272491 | A1 | * | 10/2010 | Sasaki et al. | 400/611 |
| 2011/0129280 | A1 | * | 6/2011 | Furihata et al. | 400/619 |

FOREIGN PATENT DOCUMENTS

| | | | | | |
|---|---|---|---|---|---|
| JP | 11020262 | A | * | 1/1999 | |
| JP | 11-291572 | A | | 10/1999 | |
| JP | 2001030570 | A | * | 2/2001 | |
| JP | 2001-283401 | A | | 10/2001 | |
| JP | 2004243703 | A | * | 9/2004 | B41J 25/308 |
| JP | 2006247998 | A | * | 9/2006 | |
| JP | 2006248070 | A | * | 9/2006 | |
| JP | 2006256229 | A | * | 9/2006 | |
| JP | 2009279762 | A | * | 12/2009 | |

* cited by examiner

GAP CONTROL METHOD FOR A MEDIA PROCESSING DEVICE, AND A MEDIA PROCESSING DEVICE

BACKGROUND

1. Technical Field

The present invention relates to a media processing device that conveys a recording medium having magnetic ink characters printed thereon through a media transportation path, and reads the magnetic ink characters and prints on the recording medium. The invention relates more particularly to a gap control method for a media processing device that can convey the recording medium without interference when reading magnetic ink characters, and to such a media processing device.

2. Related Art

Media processing devices that read magnetic ink characters printed on checks and print an endorsement on the checks are used for electronically processing checks. This type of media processing device is described in JP2001-283401A.

The media processing device taught in JP2001-283401A conveys checks or other recording media through a media transportation path passed a reading position and a printing position. The magnetic ink characters are read by a magnetic head by passing the recording medium at the reading position at a constant speed in contact with the magnetic head. After reading is completed, printing is done using a printhead at the printing position.

A small device size is desirable because the media processing devices used for check processing are installed at teller windows in banks, for example. As a result, the distance between the reading position and the printing position on the media transportation path is short, and the leading end of the recording medium reaches the printing position while the magnetic ink characters are still being read at the reading position. When the leading end of the recording medium reaches the printing position, the leading end of the recording medium may contact and catch on the printhead, thereby impeding media conveyance, because the gap between the printhead and the platen at the printing position is narrow. If conveyance of the recording medium is thus impeded while reading the magnetic ink characters, the recording medium will not pass the reading position at a constant speed, and magnetic ink character reading errors can easily occur.

The printing device taught in JP11-291572A has two flat surfaces formed at different angular positions on the outside surface of a cylindrical platen, and by rotating the platen sets one flat surface opposite the printhead to maintain a constant gap between the printhead and the platen for printing, and sets the other flat surface opposite the printhead to increase the gap between the platen and the printhead when the paper passes through.

JP08-11365A teaches a head gap adjustment mechanism that can adjust the gap between the printhead and cylindrical platen by eccentrically rotating the cylindrical platen.

Because the printing position of the printhead is determined by the platen, the recording medium is conveyed over the platen surface, and the gap between the printing surface of the recording medium and the printhead is thereby held constant. When the platen moves in the direction toward and away from the printhead, a step or gap is created between the platen and the upstream media guide that guides the recording medium to the platen. A step or gap also occurs between the platen and the downstream media guide that guides the recording medium downstream after passing the platen. As a result, smoothly conveying the recording medium by means of the platen may not be possible. It is therefore necessary to use a specially shaped cylindrical platen having flats on the outside surface as described in JP11-291572A so that a large step or gap is not created between the platen and the media guides on the upstream and downstream sides.

SUMMARY

A gap control method for a media processing device according to the invention that reads magnetic ink characters and prints on a recording medium increases the gap between the platen and printhead without moving the platen when reading magnetic ink characters, and enables smoothly conveying the recording medium.

A media processing device according to the invention that reads magnetic ink characters and prints on a recording medium increases the gap between the platen and printhead without moving the platen when reading magnetic ink characters, and can smoothly convey the recording medium.

A first aspect of the invention is a gap control method for a media processing device, including steps of: conveying a recording medium on which magnetic ink characters are printed through a media transportation path that passes a reading position of a magnetic head and a printing position of a printhead; reading the magnetic ink characters from the recording medium and printing on the recording medium at different times; conveying the recording medium in the printing operation when the gap between the printhead and a platen that defines the printing position is set to a first gap; conveying the recording medium in the reading operation when the gap is set to a second gap that is wider than the first gap; and selectively setting the gap to the first gap or the second gap by moving the printhead toward or away from the platen, which is stationary.

In this aspect of the invention the gap between the printhead and platen is set to a wide second gap during the magnetic ink character reading operation. The recording medium will therefore not contact and be caught on the printhead, or such incidents can be reduced, even if the leading end of the recording medium reaches the printing position during the magnetic ink character reading operation and the recording medium passes the printing position. The recording medium can therefore pass the reading position at a constant speed because recording medium conveyance is not impeded. Magnetic ink character reading errors can also be suppressed.

In addition, the platen is stationary, and the gap is changed by moving the printhead toward or away from the platen. Because the platen does not move, a step or gap is not created between the platen and the upstream media guide member and downstream media guide member. The recording medium can therefore always be conveyed smoothly regardless of the size of the gap. In addition, a common flat member can be used as the platen, and there is no need to use a special shape or construction.

In another aspect of the invention, the gap is set to the second gap when the printing operation and the reading operation are not executing. Because a wide gap is thus set between the printhead and platen in the standby state, recording media can be continuously conveyed efficiently.

Further preferably in another aspect of the invention, when the printhead prints on the recording medium through an ink ribbon, the control method includes steps of monitoring opening and closing an access cover for replacing the ink ribbon, and setting the gap to the second gap when the access cover is open.

When the printhead is an impact or thermal transfer head that uses an ink ribbon, part of the ink ribbon must be set between the printhead and platen when the ink ribbon is replaced. Therefore, by opening the gap between the printhead and the platen when the access cover is opened to replace the ink ribbon, the ink ribbon can be easily replaced.

A gap control method according to another aspect of the invention preferably also has steps of monitoring if the recording medium is jammed inside the media transportation path; and setting the gap to the second gap when the recording medium is jammed.

This aspect of the invention opens the gap between the printhead and platen when the recording medium jams, and therefore makes removing the recording medium from the media transportation path easy.

Further preferably in a gap control method according to another aspect of the invention, the media transportation path part downstream in the transportation direction from the reading position on the media transportation path is defined by a media guide member disposed opposite the platen; and the control method further includes steps of positioning the media guide member to a first media guide position when the gap is set to the first gap, and moving the media guide member to a second media guide position separated farther from the platen than the first media guide position when the gap is set to the second gap.

With this aspect of the invention the media transportation path part downstream in the transportation direction from the reading position on the media transportation path widens in conjunction with the change in the gap between the printhead and platen. The recording medium therefore does not catch on the media transportation path, and recording medium conveyance is not impeded. As a result, errors when reading the magnetic ink characters can be suppressed because the recording medium passes the reading position at a constant speed. In addition, because the media guide member on the printhead side does not require positioning with the high precision required for the platen that determines the printing position of the printhead, the structure that moves with the printhead can also be simplified.

Another aspect of the invention is a media processing device having a media transportation path; a media transportation mechanism that conveys a recording medium through the media transportation path; a reading position and a printing position disposed to the media transportation path along the media transportation direction; a magnetic head that reads magnetic ink characters printed on the recording medium passing the reading position; a printhead that prints on the recording medium passing the printing position; a platen disposed opposite the printhead to define the printing position; a gap changing mechanism that sets the gap between the printhead and the platen to a first gap or a second gap that is wider than the first gap by moving the printhead in a direction approaching and a direction away from the platen; a media detection device that detects passage of a printing area in which the magnetic ink characters are printed on the recording medium passed the reading position; and a gap control unit that sets the gap to the second gap until the printing area on the recording medium is detected to have completely passed the reading position, and returns the gap to the first gap when the printing area on the recording medium is detected to have completely passed the reading position.

With this aspect of the invention, until the printing area on the recording medium finishes passing the reading position, that is, during the magnetic ink character reading operation, the gap between the printhead and platen is set to a wide second gap. The recording medium will therefore not contact and be caught on the printhead, or such incidents can be reduced, even if the leading end of the recording medium reaches the printing position during the magnetic ink character reading operation and the recording medium passes the printing position. The recording medium can therefore pass the reading position at a constant speed because recording medium conveyance is not impeded. Magnetic ink character reading errors can also be suppressed.

In addition, the platen is stationary, and the gap is changed by moving the printhead toward or away from the platen. Because the platen does not move, a step or gap is not created between the platen and the upstream media guide member and downstream media guide member. The recording medium can therefore always be conveyed smoothly regardless of the size of the gap. In addition, a common flat member can be used as the platen, and there is no need to use a special shape or construction.

In another aspect of the invention, the gap control unit sets the gap to the second gap when the printhead finishes printing. Because a wide gap is thus set between the printhead and platen in the standby state, recording media can be continuously conveyed efficiently.

Preferably in another aspect of the invention, when the printhead prints on the recording medium through an ink ribbon, the media processing device further includes a detector that detects opening and closing an access cover for replacing the ink ribbon, and the gap control unit sets the gap to the second gap when the access cover is detected to be open.

When the printhead is an impact or thermal transfer head that uses an ink ribbon, part of the ink ribbon must be set between the printhead and platen when the ink ribbon is replaced. Therefore, by opening the gap between the printhead and the platen when the access cover is opened to replace the ink ribbon, the ink ribbon can be easily replaced.

A media processing device according to another aspect of the invention preferably also has a second media detection device that detects the recording medium at a position downstream in the media transportation direction from the printing position on the media transportation path; wherein the gap control unit sets the gap to the second gap when the recording medium has not been detected by the second media detection device when the recording medium transportation distance of the media transportation mechanism exceeds a predetermined transportation distance.

This aspect of the invention makes removing a jammed recording medium from the media transportation path easy.

In a media processing device according to another aspect of the invention, the gap changing mechanism preferably includes a printhead support member on which the printhead is mounted, and a printhead moving mechanism that moves the printhead support member in the direction in which the gap changes between the first gap and the second gap.

With this aspect of the invention, until the printing area of the magnetic ink characters on the recording medium passes the reading position, the printhead is retracted to a retracted position that is farther removed from the platen than the printing position. The recording medium will therefore not contact and be caught on the printhead, or such incidents can be reduced, even if the leading end of the recording medium reaches the printing position during the magnetic ink character reading operation and the recording medium passes the printing position. The recording medium can therefore pass the reading position at a constant speed because recording medium conveyance is not impeded. Magnetic ink character reading errors can also be suppressed.

Further preferably in another aspect of the invention, the media processing device also has a media guide member that is disposed opposite the platen and defines a media transportation path part on the downstream side in the transportation direction from the reading position of the media transportation path. The media guide member is disposed to the printhead support member, is positioned to a first media guide position when the gap is set to the first gap, and is moved to a second media guide position separated farther from the platen than the first media guide position when the gap is set to the second gap.

With this aspect of the invention the media transportation path part downstream in the transportation direction from the reading position on the media transportation path widens in conjunction with movement of the printhead. The recording medium therefore does not catch on the media transportation path, and recording medium conveyance is not impeded. As a result, errors when reading the magnetic ink characters can be suppressed because the recording medium passes the reading position at a constant speed. In addition, because there is no need to provide a separate mechanism for moving the media guide member, the device can be rendered smaller, more compact, and at a lower cost.

When the media processing device according to another aspect of the invention is configured to print on both sides of a check or other recording medium, a second printhead is disposed to a media transportation path part downstream from the printing position on the media transportation path; and a second platen is disposed opposite the second printhead for determining the printing position of the second printhead. The second platen is mounted on the printhead support member, the second printhead is disposed to a stationary position, the space between the second platen and the second printhead is set to a third gap when the gap is set to the first gap, and the space between the second platen and the second printhead is set to a fourth gap that is wider than the third gap when the gap is set to the second gap.

With this aspect of the invention the media transportation path widens at the printing position and second printing position while the recording medium is being read, and the recording medium can therefore be conveyed smoothly. This aspect of the invention is also useful for rendering the media processing device small, compact, and at a low cost because a separate mechanism for changing the gap between the second printhead and the second platen is not needed.

Other objects and attainments together with a fuller understanding of the invention will become apparent and appreciated by referring to the following description and claims taken in conjunction with the accompanying drawings.

DESCRIPTION OF EMBODIMENTS

A check processing device according to a preferred embodiment of a media processing device according to the invention is described below with reference to the accompanying figures.

General Configuration

Figure 1:
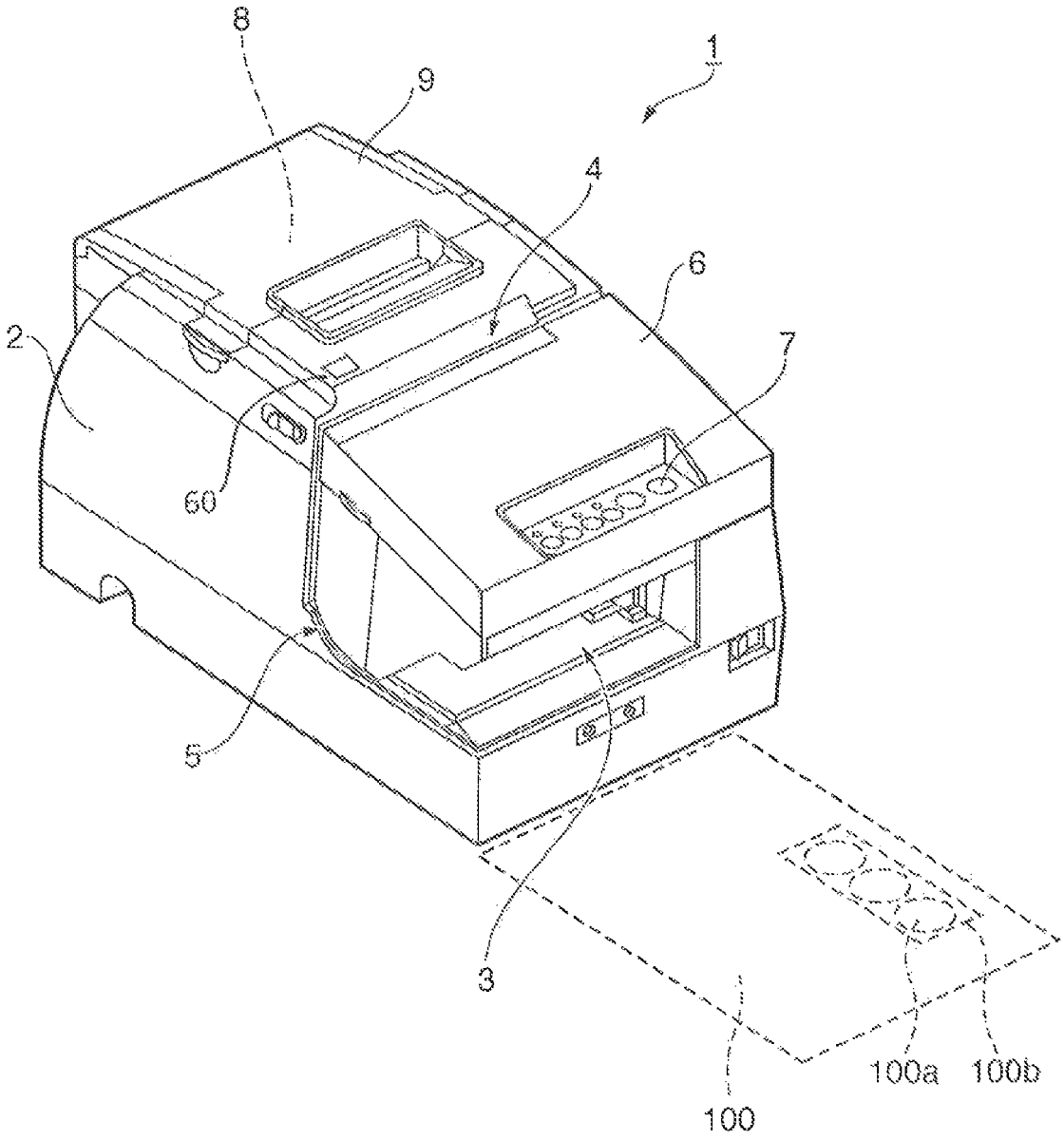
FIG. 1 is an oblique view of a check processing device according to a preferred embodiment of the invention.

FIG. 1 is an external oblique view of a check processing device. The check processing device 1 has a basically rectangular box-like outside case 2. A media insertion opening 3 for inserting a check (recording medium) 100 is disposed with a specific width widthwise to the printer on the front left side of the outside case 2.

A media exit 4 from which processed checks 100 are discharged is disposed with a specific width widthwise to the printer in the top of the outside case 2 in the middle between the front and back of the printer.

A media transportation path 5 that extends from the media insertion opening 3 toward the back of the device and then curves and extends to the top is formed between the media insertion opening 3 and the media exit 4. The media transportation path 5 is also open to the left side of the outside case 2.

The top of the outside case 2 in front of the media exit 4 is covered by a front cover 6, and an operating panel 7 is disposed at the front of the front cover 6. A compartment 8 is disposed and a cover 9 for opening and closing the compartment 8 is attached at the back of the top of the outside case 2. The cover 9 is pivotably attached at the back end thereof to the outside case 2. An ink ribbon cartridge 10 (see FIG. 3) that stores an ink ribbon used for printing can be replaced when the cover 9 is opened.

Figure 2:
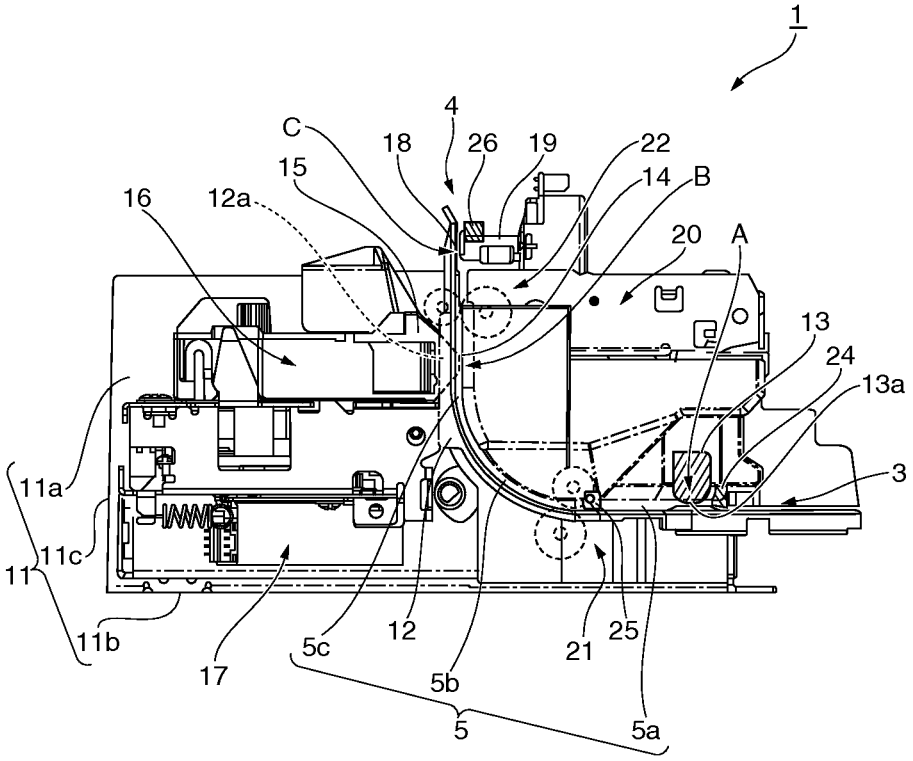
FIG. 2 is a side view showing the internal configuration of the check processing device.

FIG. 2 is a side view showing the internal configuration of the check processing device. External parts including the outside case 2, front cover 6, and cover 9 are removed in FIG. 2.

As shown in FIG. 2, the check processing device 1 has a main frame 11 including left and right side panels 11*a* (the left panel not shown), a bottom panel 11*b*, and a back panel 11*c*.

The media transportation path 5 is located towards the front of the device inside the main frame 11, and includes a first transportation path part 5*a* that extends from the media insertion opening 3 towards the back of the device, a curved transportation path part 5*b* that curves upward from the back end of the first transportation path part 5*a*, and a third transportation path part 5*c* that extends upward from the top end of the curved part. The guide surface on the bottom side of the first transportation path part 5*a* and curved transportation path part 5*b*, and the guide surface on the back side of third transportation path part 5*c* are defined by a media guide member 12.

A reading position A for reading the magnetic ink characters 100*a* printed on a check 100 is disposed to the first transportation path part 5*a*. A magnetic head 13 is disposed to the reading position A. The magnetic head 13 is located above the first transportation path part 5*a* with the reading part 13*a* facing down.

A first printing position B and a second printing position C are sequentially disposed to the third transportation path part 5*c* with the first printing position B below the second printing position C. The distance between the reading position A and the first printing position B on the media transportation path 5 is shorter than the length of the check 100 in the transportation direction.

The first printing position B is defined by a first platen 14 that faces the back of the check processing device 1. A first printhead 15 is disposed opposite the first platen 14. The first printhead 15 is a serial impact dot matrix (SIDM) printhead that prints by driving recording wires against an ink ribbon to transfer ink from the ink ribbon to the recording medium, and is disposed to a first printhead unit 16 located on the side of the third transportation path part 5*c* towards the back of the check processing device 1. A rectangular opening 12*a* that extends widthwise to the device is formed in the media guide member 12 at a position opposite the first platen 14. The first printhead 15 opposes the first platen 14 through this opening 12*a*.

The first printhead unit 16 is supported on the main frame 11 (printhead support member) movably in the direction between the device front and back. The first printhead unit 16 can also move in the direction between the device front and back by means of a unit frame moving mechanism 17 (printhead moving mechanism) located therebelow.

The second printing position C is determined by a second platen 18 that faces the device front, and a second printhead 19 is located opposite the second platen 18. The second platen 18 is disposed at the top end part of the media guide member 12. The second printhead 19 is mounted on a second printhead unit 20 disposed on the side of the third transportation path part 5*c* to the front of the device. The second printhead 19 is also a serial impact dot matrix (SIDM) printhead.

A first paper feed roller pair 21 is disposed at the back end of the first transportation path part 5*a* between the reading position A and the first printing position B. A second paper feed roller pair 22 is disposed to the third transportation path part 5*c* between the first printing position B and second printing position C. Drive power from a paper feed motor (FIG. 4) is transferred to the first paper feed roller pair 21 and second paper feed roller pair 22. The first paper feed roller pair 21, second paper feed roller pair 22, and paper feed motor are parts of the media transportation mechanism that conveys checks 100 through the media transportation path 5.

A first paper detector 24 (media detector) for detecting the leading end and trailing end of a check 100 is disposed at the front end of the first transportation path part 5*a* between the reading position A and the media insertion opening 3. In other words, the first paper detector 24 detects insertion of a check 100 from the media insertion opening 3, and detects when the inserted check 100 has completely passed the detection position of the first paper detector 24.

A second paper detector 25 for detecting passage of the leading end of the check 100 is disposed at the back end of the first transportation path part 5*a* between the reading position A and the first printing position B.

A third paper detector 26 (second media detector) for detecting passage of the leading end of the check 100 and discharge of the check 100 from the media exit 4 is disposed near the second printing position C. Each of the paper detectors 24, 25, 26 is a reflective photosensor, for example.

First Printhead Unit

Figure 3:
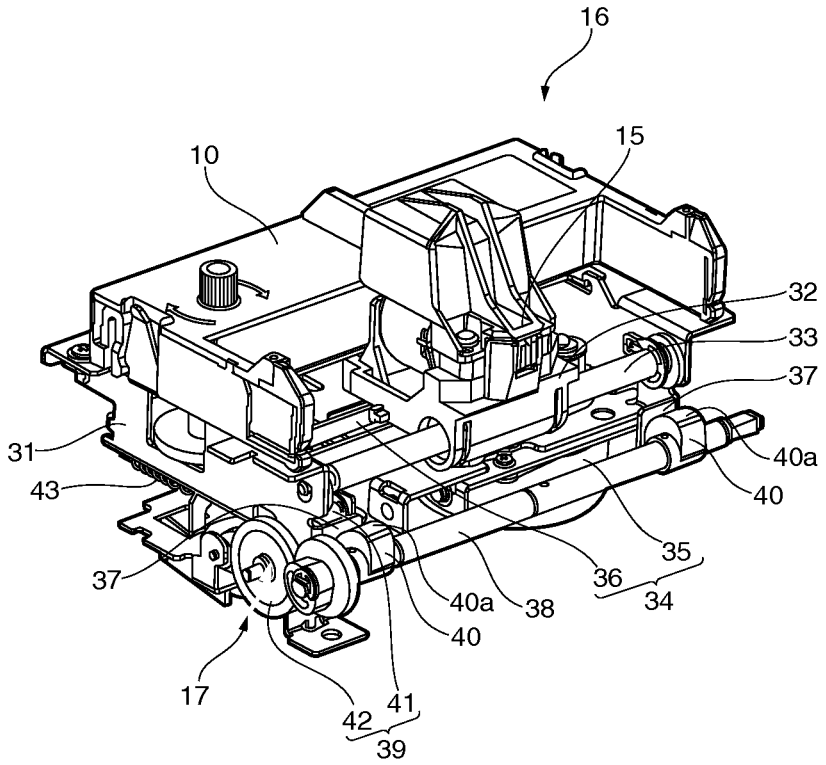
FIG. 3 is an oblique view of the first printhead unit and head unit moving mechanism.
Figure 4A:
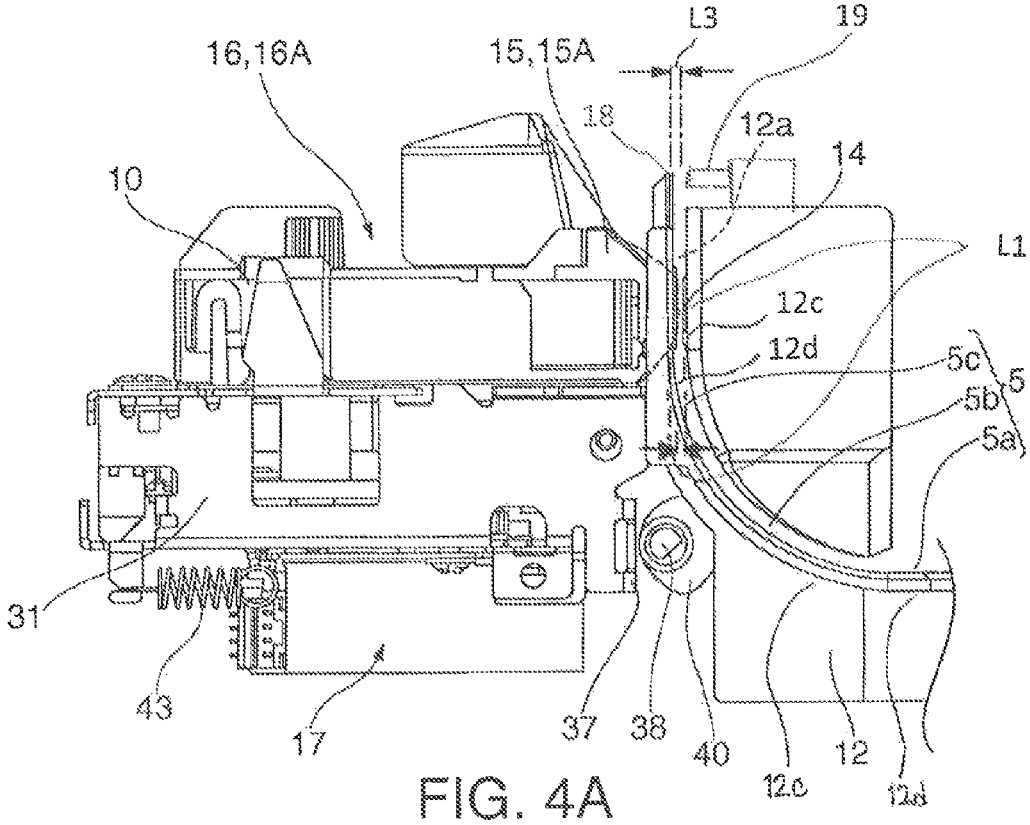
FIG. 4A describes movement of the first printhead unit and the printhead.
Figure 4B:
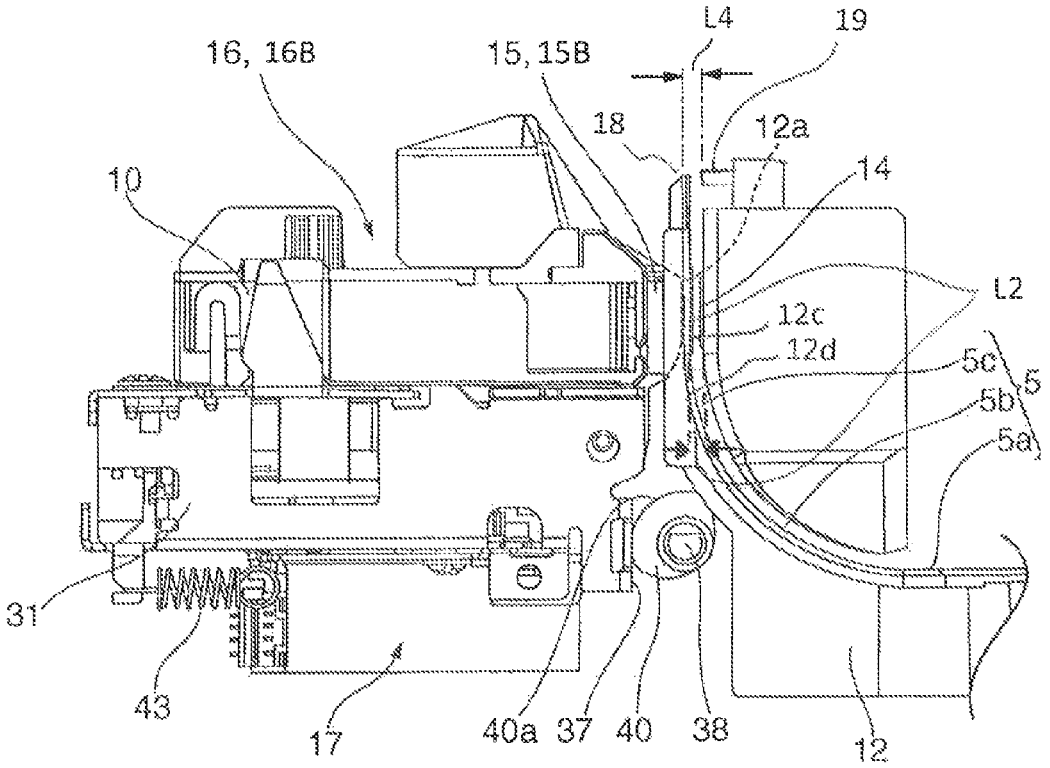
FIG. 4B describes movement of the first printhead unit and the printhead.

FIG. 3 is an oblique view of the first printhead unit 16 and unit frame moving mechanism 17. FIG. 4A is a side view of the first printhead 15 at the printing position, and FIG. 4B is a side view of the first printhead 15 at the retracted position.

The first printhead unit 16 has a head unit frame 31 that is supported on the main frame 11 movably in the direction between the device front and back. A carriage guide shaft 33 that guides a carriage 32 that carries the first printhead 15 widthwise to the device extends widthwise at the front of the head unit frame 31. A carriage transportation mechanism 34 for moving the carriage 32 bidirectionally along the carriage guide shaft 33 is disposed to the head unit frame 31 behind the carriage guide shaft 33.

The carriage transportation mechanism 34 includes a timing belt 36 and a carriage motor 35 disposed below the head unit frame 31. An ink ribbon cartridge 10 storing the ink ribbon from which ink is transferred to the check 100 by the first printhead 15 is set on top of the head unit frame 31. A pair of flat surfaces 37 that face the device front at both ends widthwise to the device are disposed at the bottom of the front ends of the head unit frame 31.

The unit frame moving mechanism 17 includes a rotating shaft 38 that spans rotatably between the left and right side panels 11*a* of the main frame 11, a drive mechanism 39 that is fixed to the bottom panel 11*b* of the main frame 11 for rotationally driving the rotating shaft 38, and a pair of cams 40 attached to the left and right ends of the rotating shaft 38.

The drive mechanism 39 includes a motor 41 for moving the first printhead unit 16, and a speed reducing gear train 42 for transferring drive power from the head unit movement motor 41 to the rotating shaft 38. As shown in FIG. 4, the pair of cams 40 are fan shaped when seen along the axis of the rotating shaft 38, and rotate on an axis of rotation passing through the center of the fan shape. The outside surfaces of the pair of cams 40 are the cam faces 40*a*, and the cam faces 40*a* are disposed to positions where they can contact the pair of flats 37 disposed to the head unit frame 31.

The first printhead unit 16 is urged to a front position 16A by a coil spring connected between the bottom of the first printhead unit 16 and the unit frame moving mechanism 17. As a result, the cam faces 40*a* of the cams 40 and the flats 37 of the head unit frame 31 are constantly held in contact. When the rotating shaft 38 of the unit frame moving mechanism 17 is rotationally driven, the flats 37 of the head unit frame 31 are therefore pushed in the direction between the device front and back by the cam faces 40*a* of the pair of cams 40 on the drive mechanism 39, and the first printhead unit 16 in the direction between the device front and back.

In this embodiment of the invention the first printhead unit 16 can move by rotation of the cams 40 between the front position 16A shown in FIG. 4A towards the device front, and a back position 16B shown in FIG. 4B towards the device back.

When the first printhead unit 16 moves to the front position 16A, the first printhead 15 is positioned to the printing position 15A. When the first printhead unit 16 retracts to the back position 16B, the first printhead 15 retracts from the printing position 15A to the retracted position 15B separated from the platen.

When the first printhead 15 is positioned to the printing position 15A, the gap between the first printhead 15 and first platen 14 is a predetermined first gap L1. This first gap L1 is a gap suitable for the first printhead 15 to print on a check 100 on the first platen 14. When the first printhead 15 is retracted to the retracted position 15B, the gap between the first printhead 15 and first platen 14 is a second gap L2 that is wider than the first gap L1.

Control System

Figure 5:
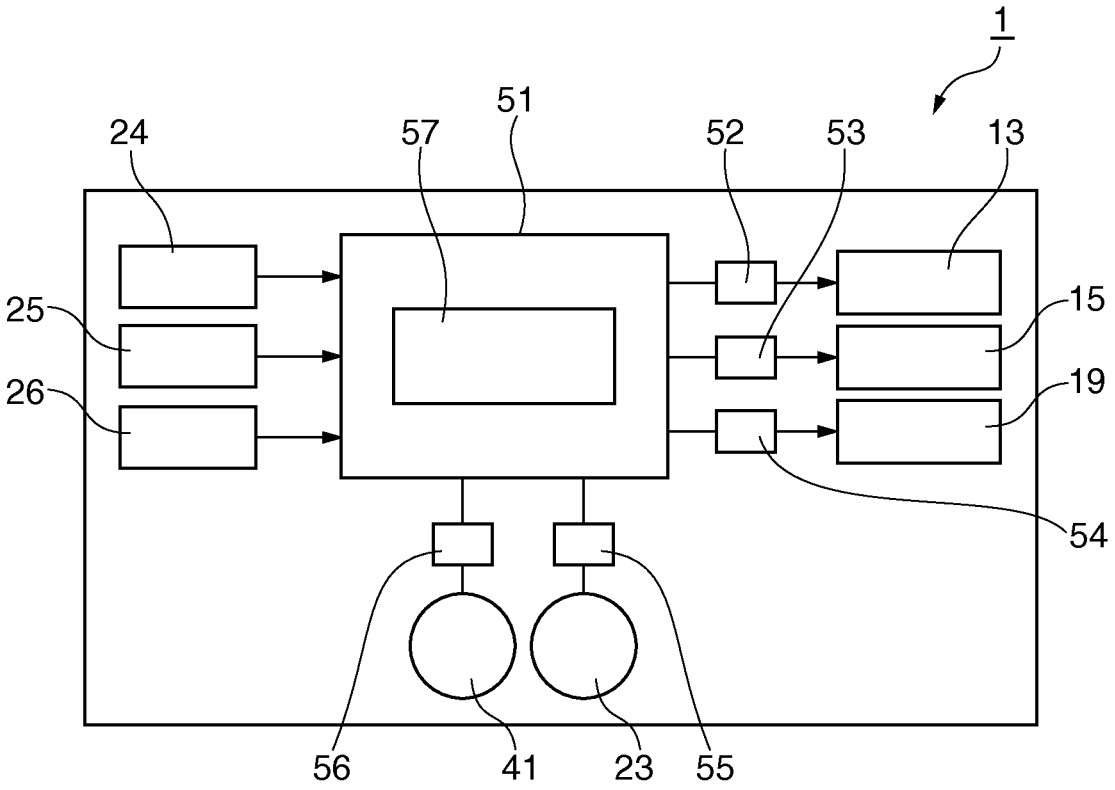
FIG. 5 is a block diagram of the control system of the check processing device.

FIG. 5 is a block diagram schematically describing the control system of the check processing device.

The control system of the check processing device 1 is built around a control unit 51 including a CPU, ROM, and RAM. Signals from the first to third paper detectors 24, 25, 26 are input to the control unit 51. The control unit 51 is connected to the magnetic head 13, first printhead 15, second printhead 19, paper feed motor, and the head unit movement motor 41 of the first printhead unit 16 through drivers 52 to 56.

Based on the signals from the first to third paper detectors 24, 25, 26, the control unit 51 drives the paper feed motor and conveys a check 100 through the media transportation path 5. While the check 100 is conveyed passed the reading position A, the control unit 51 controls driving the magnetic head 13 to read the magnetic ink characters 100*a*. At the first printing position B and second printing position C, the control unit 51 controls driving the first printhead 15 and second printhead 19 to print on the check 100. Because the distance between the reading position A and the first printing position on the media transportation path 5 is shorter than the length of the check 100 in the transportation direction, reading the magnetic ink characters 100*a* occurs while the leading end of the check 100 passes the first printing position B.

The control unit 51 has a gap control unit 57 that sets the gap between the first printhead 15 and first platen 14 to the first gap L1 during printing, and sets the gap to the second gap L2 during magnetic ink character reading.

More specifically, during initialization such as when the power turns on, the gap control unit 57 sets the first printhead unit 16 to the back position 16B, and holds the first printhead 15 at the retracted position 15B until the magnetic head 13 completes the magnetic ink characters 100*a* reading operation. More specifically, by setting the first printhead unit 16 to the back position 16B until it is detected that the magnetic ink character 100*a* printing area 100*b* on the check 100 passed the reading position A, the first printhead 15 is held retracted to the retracted position 15B.

When it is then detected that the printing area 100*b* of the magnetic ink characters 100*a* on the check 100 has passed the reading position A, that is, that the magnetic head 13 has finished reading the magnetic ink characters 100*a*, the gap control unit 57 moves the first printhead unit 16 to the front position 16A and thereby moves the first printhead 15 to the printing position 15A.

In addition, when the first printhead 15 and second printhead 19 finish printing, the gap control unit 57 moves the first printhead unit 16 from the front position 16A to the back position 16B, and retracts the first printhead 15 from the printing position 15A to the retracted position 15B.

When the leading end of the check 100 is detected by means of the second paper detector 25, the gap control unit 57 monitors the paper feed distance of the check 100 from the number of steps the paper feed motor is driven, and if the check 100 is not detected by the third paper detector (second media detector) when this paper feed distance exceeds a predetermined feed distance, the gap control unit 57 moves the first printhead unit 16 from the front position 16A to the back position 16B, and retracts the first printhead 15 from the printing position 15A to the retracted position 15B.

This predetermined feed distance is an amount sufficient for the check 100 to be conveyed from the second paper detector 25 to the third paper detector 26 on the media transportation path 5. As a result, if the check 100 has not been detected by the third media detector when the paper feed distance of the check 100 exceeds the predetermined amount, the check 100 is jammed inside the media transportation path 5.

Note that the gap control unit 57 could monitor the feed distance of the check 100 based on the number of steps the paper feed motor is driven from the time that insertion of a check 100 is detected by the first paper detector 24, and if the check 100 is not detected by the third paper detector (second media detector) when this feed distance exceeds a predetermined second feed amount, move the first printhead unit 16 from the front position 16A to the back position 16B, and retract the first printhead 15 from the printing position 15A to the retracted position 15B.

Check Processing Operation

Figure 6:
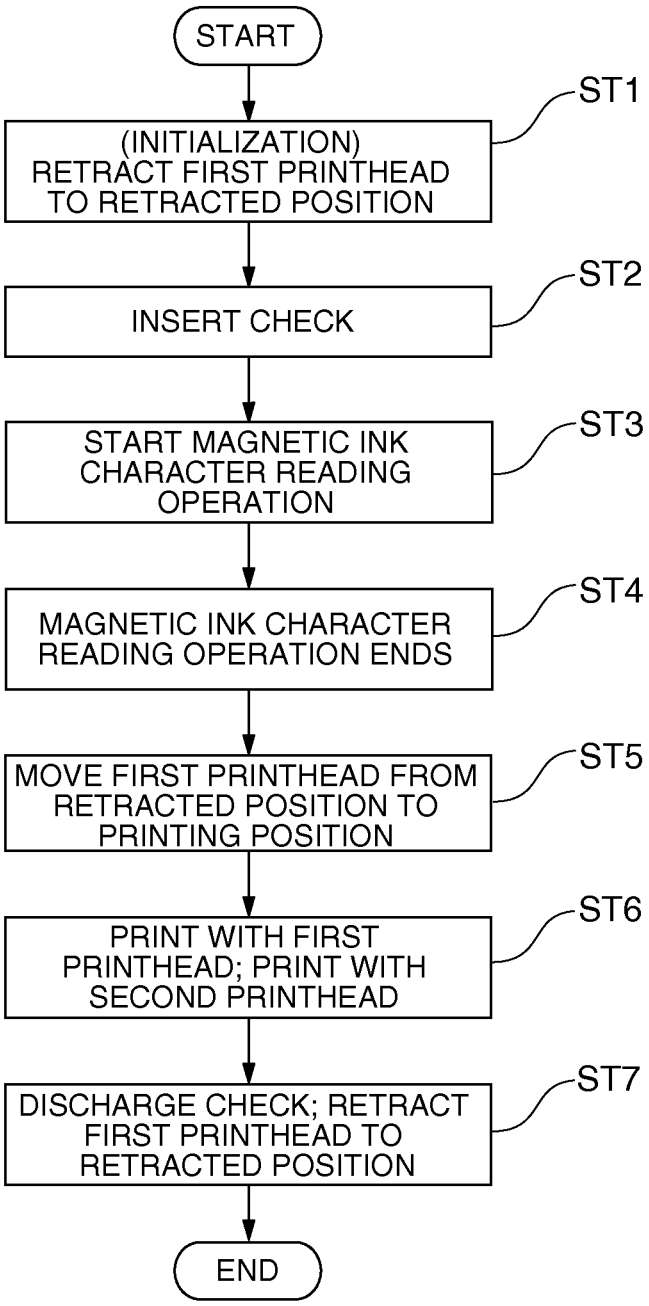
FIG. 6 is a flow chart of the check processing operation.

FIG. 6 is a flow chart of the check processing operation.

When the power turns on, the first printhead unit 16 is set to the back position 16B, and the first printhead 15 is retracted to the retracted position 15B. As a result, the gap is set to the wide second gap L2 (step ST1).

A check 100 is then inserted to the media transportation path 5 from the media insertion opening 3 with the front on which the magnetic ink characters 100*a* are printed facing up (step ST2). When the first paper detector 24 detects that a check 100 was inserted to the media transportation path 5, the paper feed motor is driven and conveyance of the check 100 by the first paper feed roller pair 21 starts.

When the leading end of the check 100 is detected by the second paper detector 25, the control unit 51 starts reading the magnetic ink characters 100*a* by means of the magnetic head 13 (step ST3). More specifically, the control unit 51 conveys the check 100 at a constant speed by means of the first paper feed roller pair 21 passed the reading position A, and executes the magnetic ink character 100*a* reading operation by means of the magnetic head 13 while the check 100 passes the reading position A.

When the trailing end of the check 100 is detected by the first paper detector 24, the control unit 51 drives the paper feed motor an additional specific number of steps to convey the check 100 downstream in the transportation direction. Because the part of the check 100 where the magnetic ink characters 100*a* are printed moves to the downstream side of the reading position A in the transportation direction as a result of this conveyance, the control unit 51 stops the magnetic ink character 100*a* reading operation (step ST4).

When reading the magnetic ink characters 100*a* ends, the gap control unit 57 moves the first printhead 15 to the printing position 15A (step ST5). More specifically, the gap control unit 57 moves the first head frame to the front position 16A by means of the unit frame moving mechanism 17, and moves the first printhead 15 to the printing position 15A. As a result, the gap is set to the first gap L1.

The check 100 is then conveyed through the third transportation path part 5*c* passed the first printing position B and second printing position C. An endorsement is then printed on the back of the check 100 at the first printing position B, and the front of the check is printed at the second printing position C (step ST6).

The check 100 is then discharged from the media exit 4. When discharge of the check 100 is detected by the third paper detector 26, the gap control unit 57 moves the first printhead 15 to the retracted position 15B (step ST7). More specifically, the unit frame moving mechanism 17 moves the first head frame to the back position 16B, and moves the first printhead 15 to the retracted position 15B. As a result, the gap is set to the second gap L2.

In the embodiment described above the first printhead 15 is retracted from the printing position 15A where it can print on the check 100 to the retracted position 15B separated from the first platen 14 until the printing area 100*b* of the magnetic ink characters 100*a* on the check 100 has passed the reading position A. More specifically, while reading the magnetic ink characters 100*a*, the gap between the first printhead 15 and first platen 14 is set to a wide second gap L2. As a result, even if the leading end of the check 100 reaches the first printing position B so that the check 100 passes the first printing position B while the magnetic ink characters 100*a* are being read because the distance between the reading position A and the first printing position B is shorter than the length of the check 100 in the transportation direction, the check 100 touching and catching on the first printhead 15 can be prevented or reduced. The check 100 can therefore pass the reading position A at a constant speed because conveyance of the check 100 is not impeded. The occurrence of reading errors while reading the magnetic ink characters 100*a* can therefore be suppressed.

In addition, the first platen 14 is disposed at a stationary position, and the platen gap is changed by moving the first printhead 15 move toward and away from the first platen 14. When the platen moves, a step or gap can be created between the platen and the upstream side media guide surface and the downstream side media guide surface, and these can then become an obstruction that interferes with check conveyance. However, because there is no step or gap on the first platen 14 side in this embodiment of the invention, the recording medium can be always be conveyed smoothly over the surface of the first platen 14 regardless of the size of the gap. In addition, a common flat member can be used for the platen, and there is no need to use a special shape or construction. Furthermore, it is sufficient to render a moving mechanism on the side to which the movable first printhead 15 is disposed, and a special shape or construction is not required for the shape of the first printhead 15 surface. The gap adjustment mechanism can thus be rendered easily and inexpensively compared with configurations that move the platen to change the size of the gap.

In addition, the gap control unit 57 in this embodiment of the invention retracts the first printhead 15 to the retracted position 15B when processing the check 100 is completed. This embodiment of the invention is therefore suited to continuously processing checks 100 because the first printhead 15 is retracted to the retracted position 15B when the magnetic ink characters 100*a* are not being read and the outside case 2 is not being printed.

Furthermore, when the check 100 is determined to be jammed in this embodiment of the invention, the gap control unit 57 retracts the first printhead 15 to the retracted position 15B and increases the gap between the first printhead 15 and first platen 14. A jammed check 100 can therefore be easily removed from the media transportation path 5.

Other Embodiments

A configuration in which a detector 60 for detecting opening and closing of the cover 9 is disposed to the check processing device 1 in the foregoing embodiment, and the gap control unit 57 retracts the first printhead 15 to the retracted position 15B if the first printhead 15 is in the printing position 15A when the cover 9 is open, is also conceivable. More specifically, when an SIDM printhead is used as the first printhead 15, part of the ink ribbon must be set between the first printhead 15 and the first platen 14 when the ink ribbon cartridge 10 is replaced. Therefore, by retracting the first printhead 15 to the retracted position 15B when the cover 9 that is opened to replace the ink ribbon cartridge 10 is open, the gap between the first printhead 15 and first platen 14 increases and the ink ribbon cartridge 10 can be easily replaced.

A configuration that moves the downstream part of the media guide member 12 together with the first printhead 15 is also conceivable. For example, as shown by the shaded part in FIG. 4A, media guide member part 12*c* that defines the media transportation path downstream in the transportation direction from the reading position A could be rendered by an independent member, and this media guide member part 12*c* could be disposed to the main frame 11 side. When the main frame 11 then moves and the gap is set to the first gap L1, the media guide member part 12*c* is positioned to a first media guide position. When the gap is increased to the second gap L2, the media guide member part 12*c* moves from the first media guide position to a second media guide position removed from the first platen 14 toward the back of the media processing device. So that a step or gap is not created in the media transportation path as a result of media guide member part 12*c* movement, an interlaced finger joint construction may be rendered a the junction between the media guide member part 12*c* and the media guide member part 12*d* on the stationary side.

With this configuration the media transportation path part downstream in the transportation direction from the reading position A on the media transportation path 5 is wide until the printing area 100*b* of the magnetic ink characters 100*a* on the check 100 passes the reading position A. The checks 100 will therefore not catch on the media transportation path, and check 100 conveyance will not be impeded.

If the second platen 18 is disposed to media guide member part 12*c* of the media guide member 12, the second platen 18 moves with the first printhead 15 toward the device back relative to the second printhead 19, and the gap between the second platen 18 and second printhead 19 increases. Contact and catching of the check 100 on the second printhead 19 can therefore be prevented or reduced even if the leading end of the check 100 reaches the second printing position C while the magnetic ink characters 100*a* are being read. Because check 100 conveyance is thus not impeded, the check 100 can travel passed the reading position A at a constant speed. The occurrence of errors in the magnetic ink characters 100*a* reading operation can therefore be suppressed.

Because the media guide member part 12*c* that defines the media guide surface on the upstream side of the second platen 18 moves in unison with the second platen 18 in this configuration, a step or gap is not formed therebetween. The check 100 can therefore be conveyed smoothly regardless of the size of the gap. In addition, because the downstream side of the second platen 18 continues to the media exit 4 side, these parts can simply be formed so that the leading end of the check 100 conveyed over the surface of the second platen 18 does not strike parts on the media exit 4 side when the second platen 18 moves away from the second printhead 19.

While the printheads in the foregoing embodiment are SIDM printheads, but the invention is not so limited and can be applied to configurations having inkjet printheads. The invention can also be applied to configurations that use thermal transfer printheads as printheads that use an ink ribbon.

Furthermore, the foregoing embodiment applies the invention to a check processing device, but the invention can obviously be applied to devices that process media other than checks.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A gap control method for a media processing device, comprising steps of:

conveying a recording medium on which magnetic ink characters are printed through a media transportation path that passes a reading position of a magnetic head and a printing position of a printhead, the media transportation path being defined by a media guide member;

reading the magnetic ink characters from the recording medium and printing on the recording medium at different times;

conveying the recording medium in a first direction while printing on the recording medium when a gap between the printhead and a platen that defines the printing position is set to a first gap;

conveying the recording medium in a second direction that is perpendicular to the first direction while reading the magnetic ink characters when the gap is set to a second gap that is wider than the first gap;

selectively setting the gap to the first gap or the second gap by moving the printhead toward or away from the platen, which is not capable of any movement relative to a frame of the media processing device, such that a distance between the magnetic head and a portion of the media guide member opposed to the magnetic head does not change when the printhead is moved;

conveying the recording medium past a second printing position, downstream of the printing position, when a space between a second printhead and a platen that defines the second printing position is set to a third gap; and selectively setting the space to the third gap or a fourth gap by moving the second printhead toward or away from the platen, wherein a difference between the first gap and the second gap is equal to a difference between the third gap and the fourth gap.

2. The gap control method for a media processing device described in claim 1, wherein:

the gap is set to the second gap when the not printing on the recording medium or reading magnetic ink characters.

3. The gap control method for a media processing device described in claim 1, wherein:

the printhead prints on the recording medium through an ink ribbon; and the control method includes steps of monitoring opening and closing an access cover for replacing the ink ribbon, and setting the gap to the second gap when the access cover is open.

4. The gap control method for a media processing device described in claim 1, further comprising steps of:

monitoring if the recording medium is jammed inside the media transportation path; and setting the gap to the second gap when the recording medium is jammed.

5. The gap control method for a media processing device described in claim 1, wherein:

the media transportation path part downstream in the transportation direction from the reading position on the media transportation path is defined by a media guide member disposed opposite the platen; and the control method further includes steps of positioning the media guide member to a first media guide position when the gap is set to the first gap, and moving the media guide member to a second media guide position separated farther from the platen than the first media guide position when the gap is set to the second gap.

6. A media processing device comprising:

an L-shaped media transportation path defined by a media guide member;

a media transportation mechanism that conveys a recording medium through the media transportation path;

a reading position and a printing position disposed to the media transportation path along a media transportation direction;

a magnetic head that reads magnetic ink characters printed on the recording medium passing the reading position;

a printhead that prints on the recording medium passing the printing position;

a platen that is not capable of any movement relative to a frame of the media processing device and is disposed opposite the printhead to define the printing position;

a gap changing mechanism that sets a gap between the printhead and the platen to a first gap or a second gap that is wider than the first gap by moving the printhead in a direction approaching and a direction away from the platen, such that a distance between the magnetic head and a portion of the media guide member opposed to the magnetic head does not change when the printhead is moved, wherein the gap changing mechanism includes a printhead support member on which the printhead is mounted;

a media detection device that detects passage of a printing area in which the magnetic ink characters are printed on the recording medium passed the reading position;

a gap control unit that sets the gap to the second gap until the printing area on the recording medium is detected to have completely passed the reading position, and returns the gap to the first gap when the printing area on the recording medium is detected to have completely passed the printing position;

a second printhead disposed to a media transportation path part downstream from the printin position on the transportation path; and a second platen disposed opposite the second printhead for determining the printing position of the second printhead;

wherein the second platen is mounted on the printhead support member, the second printhead is disposed to a stationary position, the space between the second platen and the second printhead is set to a third gap when the gap is set to the first gap, and the space between the second platen and the second printhead is set to a fourth gap that is wider than the third gap when the gap is set to the second gap, wherein a difference between the first gap and the second gap is equal to a difference between the third gap and the fourth gap.

7. The media processing device described in claim 6, wherein:

the gap control unit sets the gap to the second gap when the printhead finishes printing.

8. The media processing device described in claim 6, wherein:

the printhead prints on the recording medium through an ink ribbon;

the media processing device further includes a detector that detects opening and closing an access cover for replacing the ink ribbon; and the gap control unit sets the gap to the second gap when the access cover is detected to be open.

9. The media processing device described in claim 6, further comprising:

a second media detection device that detects the recording medium at a position downstream in the media transportation direction from the printing position on the media transportation path;

wherein the gap control unit sets the gap to the second gap when the recording medium has not been detected by the second media detection device when the recording medium transportation distance of the media transportation mechanism exceeds a predetermined transportation distance.

10. The media processing device described in claim 6, wherein:

the gap changing mechanism further includes a printhead moving mechanism that moves the printhead support member in the direction in which the gap changes between the first gap and the second gap.

11. The media processing device described in claim 10, further comprising:

a media guide member that is disposed opposite the platen and defines a media transportation path part on the downstream side in the transportation direction from the reading position of the media transportation path, wherein the media guide member is disposed to the printhead support member, is positioned to a first media guide position when the gap is set to the first gap, and is moved to a second media guide position separated farther from the platen than the first media guide position when the gap is set to the second gap.

12. A media processing device comprising:

a media transportation path defined by a media guide member;

a media transportation mechanism that conveys a recording medium through the media transportation path;

a reading position and first and second printing positions disposed to the media transportation path along a media transportation direction;

a magnetic head that reads magnetic ink characters printed on the recording medium passing the reading position;

a first printhead that prints on the recording medium passing the first printing position;

a first platen that is not capable of any movement relative to a frame of the media processing device and is disposed opposite the printhead to define the first printing position;

a second printhead that is not capable of any movement relative to the frame of the media processing device and is disposed to a media transportation path part downstream from the first printing position on the media transportation path; and a second platen disposed opposite the second printhead for determining the second printing position of the second printhead;

a gap changing mechanism that sets a gap between the first printhead and the first platen to a first gap or a second gap that is wider than the first gap by moving the first printhead in a direction approaching and a direction away from the first platen, and that sets a space between the second platen and the second printhead to a third gap or a fourth gap that is wider than the third gap by moving the second platen in a direction approaching and a direction away from the second printhead, such that a distance between the magnetic head and a portion of the media guide member opposed to the magnetic head does not change when the first printhead or the second platen is moved, wherein a difference between the first gap and the second gap is equal to a difference between the third gap and the fourth gap;

a media detection device that detects passage of a printing area in which the magnetic ink characters are printed on the recording medium passed the reading position; and a gap control unit that sets the gap to the second gap and the space to the fourth gap until the printing area on the recording medium is detected to have completely passed the reading position, and returns the gap to the first gap and the space to the third gap when the printing area on the recording medium is detected to have completely passed the first and second printing positions.

* * * * *